US008936149B2

(12) United States Patent
Smalley

(10) Patent No.: US 8,936,149 B2
(45) Date of Patent: Jan. 20, 2015

(54) CARRIER FOR BOTTLES

(71) Applicant: Graphic Packaging International, Inc., Atlanta, GA (US)

(72) Inventor: Brian Smalley, Bristol (GB)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 13/721,993

(22) Filed: Dec. 20, 2012

(65) Prior Publication Data

US 2013/0126366 A1 May 23, 2013

Related U.S. Application Data

(63) Continuation of application No. PCT/US2011/045704, filed on Jul. 28, 2011.

(60) Provisional application No. 61/400,625, filed on Jul. 30, 2010.

(51) Int. Cl.
*B65D 85/12* (2006.01)
*B65D 85/00* (2006.01)
(Continued)

(52) U.S. Cl.
CPC ..... *B65D 85/00* (2013.01); *B65D 71/44* (2013.01); *B65D 71/48* (2013.01); *B65D 71/0022* (2013.01); *B65D 71/46* (2013.01)
USPC ..... 206/162; 206/153; 206/158; 206/170; 206/173; 206/187

(58) Field of Classification Search
CPC .... B65D 85/00; B65D 71/0022; B65D 71/48; B65D 71/46; B65D 71/44; B65D 2571/0029; B65D 2571/00782; B65D 2571/00314; B65D 2571/0066; B65D 2571/00271; B65D 2571/00759; B65D 2571/00771
USPC ..... 206/162, 242, 427, 153, 158, 170, 173, 206/187, 193, 139, 141, 145, 152, 147–149, 206/175, 199, 161, 151; 294/87.2, 87.26; 493/88
See application file for complete search history.

(56) References Cited

U.S. PATENT DOCUMENTS 1,527,399 A 2/1925 Davidson
1,925,102 A 9/1933 Levkoff
(Continued)

FOREIGN PATENT DOCUMENTS

CA 873185 A1 6/1971
DE 196 42 571 A1 5/1997
(Continued)

OTHER PUBLICATIONS

International Search Report and Written Opinion for PCt/US2011/045704 dated Mar. 22, 2012.

*Primary Examiner* — Andrew Perreault
*Assistant Examiner* — James M Van Buskirk
(74) *Attorney, Agent, or Firm* — Womble Carlyle Sandridge & Rice, LLP

(57) ABSTRACT

A carrier for holding a plurality of containers. The carrier can comprise a bottom panel, a top panel at least partially in face-to-face contact with the bottom panel, a handle comprising a bottom gripping portion in the bottom panel and a top gripping portion in the top panel, and at least one container receiver for at least partially receiving a respective container of the plurality of containers. The at least one container receiver is foldably connected to the handle.

34 Claims, 4 Drawing Sheets

(51) Int. Cl.

| | |
|---|---|
| ***B65D 71/44*** | (2006.01) |
| *B65D 71/48* | (2006.01) |
| *B65D 71/58* | (2006.01) |
| *B65D 71/46* | (2006.01) |

(56) References Cited

U.S. PATENT DOCUMENTS 2,005,924 A 6/1935 Wilson
2,067,749 A 1/1937 Zimmerman et al.
2,115,673 A 4/1938 Stompe
2,289,859 A 7/1942 Arthur
2,299,027 A 10/1942 Novak
2,331,038 A 10/1943 Meller
2,522,950 A 9/1950 Keith
2,669,351 A 2/1954 Carson et al.
2,694,518 A 11/1954 Zanck et al.
2,737,326 A 3/1956 Toensmeier
2,754,047 A 7/1956 Schmidt et al.
2,764,284 A 9/1956 Arneson
2,798,603 A 7/1957 Grinspoon
2,950,041 A 8/1960 Stone
2,975,934 A 3/1961 Powell
3,005,654 A 10/1961 Stone et al.
3,078,032 A 2/1963 Robinson et al.
3,128,010 A 4/1964 Forrer
3,133,634 A 5/1964 Bozdar
3,137,109 A 6/1964 Rapata
3,156,358 A 11/1964 Randrup
3,178,242 A 4/1965 Ellis et al.
3,198,378 A 8/1965 Farquhar
3,228,582 A 1/1966 Osberg
3,245,711 A 4/1966 Dantoin
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,363,928 A 1/1968 Haufe et al.
3,414,313 A 12/1968 Schwarz
3,503,498 A 3/1970 Lawrence
3,517,858 A 6/1970 Farquhar
3,528,697 A 9/1970 Wood
3,533,549 A 10/1970 Gilchrist
3,540,581 A 11/1970 Koolnis
3,601,439 A 8/1971 Poupitch
3,612,266 A 10/1971 Graser
3,627,121 A 12/1971 Deasy
3,653,503 A 4/1972 Arneson
3,688,969 A * 9/1972 Mario Gabarez ..... 229/161
3,701,416 A 10/1972 Lawrence
3,722,945 A 3/1973 Wood
3,752,305 A 8/1973 Heyne
3,767,041 A 10/1973 Graser
3,860,281 A 1/1975 Wood
3,897,873 A 8/1975 Graser
3,942,631 A 3/1976 Sutherland et al.
4,029,204 A 6/1977 Manizza
4,155,449 A 5/1979 Bryne
4,180,191 A 12/1979 Wood
4,188,766 A 2/1980 Culpepper
4,192,540 A 3/1980 Oliff
4,214,660 A 7/1980 Hunt, Jr.
4,216,861 A 8/1980 Oliff
4,222,485 A 9/1980 Focke
4,244,617 A 1/1981 Manizza
4,256,226 A 3/1981 Stone
4,304,329 A 12/1981 Graser
4,305,500 A 12/1981 Jaeschke
4,318,474 A 3/1982 Hasegawa
4,318,476 A 3/1982 Wood et al.
4,326,628 A 4/1982 Wood
4,336,898 A 6/1982 Joyce
4,364,509 A 12/1982 Holley, Jr. et al.
4,372,599 A 2/1983 Kiedaisch et al.
4,375,258 A 3/1983 Crayne et al.
4,376,509 A 3/1983 Schaffer
4,378,877 A 4/1983 Botterman et al.
4,378,878 A * 4/1983 Graser ..... 206/153
4,378,879 A 4/1983 Killy
4,382,505 A 5/1983 Sutherland et al.
4,396,143 A 8/1983 Killy
4,398,636 A 8/1983 Baxter
4,401,212 A 8/1983 Fischer
4,403,689 A 9/1983 Wood
4,417,655 A 11/1983 Forbes, Jr.
4,417,661 A 11/1983 Roccaforte
4,432,579 A 2/1984 Denmark et al.
4,438,843 A 3/1984 Graser
4,566,591 A 1/1986 Turtschan et al.
4,577,762 A 3/1986 Kuchenbecker
4,605,128 A 8/1986 Rieke
4,658,984 A 4/1987 Brunner
4,703,847 A 11/1987 Oliff
4,784,266 A 11/1988 Chaussadas
4,807,751 A 2/1989 Klygis et al.
4,817,866 A 4/1989 Wonnacott
4,890,440 A 1/1990 Romagnoli
4,949,845 A 8/1990 Dixon
4,974,771 A 12/1990 Lavery
5,101,642 A 4/1992 Alexandrov
5,103,971 A 4/1992 Schuster
5,135,104 A 8/1992 Jorba
5,137,211 A 8/1992 Summer et al.
5,139,147 A 8/1992 Sutherland
5,163,548 A 11/1992 Domansky
5,188,225 A 2/1993 Jorba
5,201,412 A 4/1993 Schuster et al.
5,219,229 A 6/1993 Sengewald
5,234,103 A 8/1993 Schuster
5,246,113 A 9/1993 Schuster
5,249,681 A 10/1993 Miller
5,267,644 A 12/1993 Tsao
5,273,156 A 12/1993 Harris
5,297,673 A 3/1994 Sutherland
5,310,050 A 5/1994 Sutherland
5,310,051 A 5/1994 Sutherland
5,318,178 A 6/1994 Davies et al.
5,323,895 A 6/1994 Sutherland et al.
5,328,024 A 7/1994 Sutherland
5,344,006 A 9/1994 Mazzeo
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,474 A 6/1995 Dalea et al.
5,443,153 A 8/1995 Sutherland
5,445,262 A 8/1995 Sutherland
5,452,799 A 9/1995 Sutherland
5,476,170 A 12/1995 Weber
5,482,185 A 1/1996 McNaughton
5,484,059 A 1/1996 Sutherland
5,503,267 A 4/1996 Sutherland
5,505,304 A 4/1996 Broskow et al.
5,505,372 A 4/1996 Edson et al.
5,520,283 A 5/1996 Sutherland
5,524,756 A 6/1996 Sutherland
5,551,566 A 9/1996 Sutherland
5,553,705 A 9/1996 Bakx
5,577,612 A 11/1996 Chesson et al.
5,593,027 A 1/1997 Sutherland
5,597,114 A 1/1997 Kramedjian et al.
5,598,920 A 2/1997 Hansen
5,620,094 A 4/1997 Naumann
5,622,309 A 4/1997 Matsuda et al.
5,638,956 A 6/1997 Sutherland
5,664,683 A 9/1997 Brody
5,667,070 A 9/1997 Miret
5,687,838 A 11/1997 Bakx
5,690,213 A 11/1997 Matsumura

(56) References Cited

U.S. PATENT DOCUMENTS

| | | | | |
|---|---|---|---|---|
| 5,690,230 | A | 11/1997 | Griffith | |
| 5,706,936 | A | 1/1998 | Bernstein | |
| 5,711,419 | A | 1/1998 | Beales et al. | |
| 5,738,217 | A | 4/1998 | Hunter | |
| 5,746,310 | A | 5/1998 | Slomski | |
| 5,791,463 | A | 8/1998 | Negelen | |
| 5,794,778 | A | 8/1998 | Harris | |
| 5,816,391 | A | 10/1998 | Harris | |
| 5,820,185 | A | 10/1998 | Gomes | |
| 5,826,783 | A | 10/1998 | Stout | |
| 5,845,776 | A | 12/1998 | Galbierz et al. | |
| 5,875,961 | A | 3/1999 | Stone et al. | |
| 5,878,876 | A | 3/1999 | Galbierz et al. | |
| 5,881,884 | A | 3/1999 | Podosek | |
| 5,921,392 | A | 7/1999 | Davis | |
| 5,921,398 | A | 7/1999 | Carroll | |
| 5,924,559 | A | 7/1999 | Carrel et al. | |
| 5,927,498 | A | 7/1999 | Saam | |
| 5,960,945 | A | 10/1999 | Sutherland | |
| 5,979,747 | A * | 11/1999 | Gnadt et al. | 229/120.17 |
| 5,984,086 | A | 11/1999 | Foushee et al. | |
| D420,575 | S | 2/2000 | Rovere | |
| 6,021,897 | A | 2/2000 | Sutherland | |
| 6,039,181 | A | 3/2000 | Whiteside | |
| 6,050,402 | A | 4/2000 | Walter | |
| 6,059,099 | A | 5/2000 | Galbierz | |
| 6,176,419 | B1 | 1/2001 | Holley, Jr. | |
| 6,223,891 | B1 | 5/2001 | Devens et al. | |
| 6,223,892 | B1 | 5/2001 | Bakx | |
| 6,241,083 | B1 | 6/2001 | Harrelson | |
| 6,283,293 | B1 | 9/2001 | Lingamfelter | |
| 6,315,111 | B1 | 11/2001 | Sutherland | |
| 6,394,272 | B1 | 5/2002 | Domansky | |
| 6,409,077 | B1 | 6/2002 | Telesca et al. | |
| D459,927 | S | 7/2002 | Flowers et al. | |
| 6,478,219 | B1 | 11/2002 | Holley, Jr. | |
| 6,484,903 | B2 | 11/2002 | Spivey et al. | |
| 6,488,322 | B2 | 12/2002 | Bakx | |
| 6,550,615 | B2 | 4/2003 | Lingamfelter | |
| 6,557,699 | B1 | 5/2003 | Focke et al. | |
| 6,578,736 | B2 | 6/2003 | Spivey | |
| 6,604,677 | B1 | 8/2003 | Sutherland et al. | |
| 6,615,984 | B2 | 9/2003 | Saulas et al. | |
| 6,669,083 | B2 | 12/2003 | Bates | |
| 6,715,639 | B2 | 4/2004 | Spivey | |
| 6,752,262 | B1 | 6/2004 | Boriani et al. | |
| 6,789,673 | B2 | 9/2004 | Lingamfelter | |
| 6,866,188 | B2 | 3/2005 | Harrelson | |
| 6,896,130 | B2 | 5/2005 | Theelen | |
| 6,902,104 | B2 | 6/2005 | Holley, Jr. et al. | |
| 6,918,487 | B2 | 7/2005 | Harrelson | |
| 6,929,172 | B2 | 8/2005 | Bates et al. | |
| 6,945,450 | B2 | 9/2005 | Rusnock | |
| 6,968,992 | B2 | 11/2005 | Schuster | |
| 6,969,172 | B2 | 11/2005 | Actis-Datta | |
| 6,974,072 | B2 | 12/2005 | Harrelson | |
| 6,991,107 | B2 | 1/2006 | Harrelson | |
| 6,997,316 | B2 | 2/2006 | Sutherland | |
| 7,000,803 | B2 | 2/2006 | Miller | |
| 7,011,209 | B2 | 3/2006 | Sutherland et al. | |
| 7,083,046 | B2 | 8/2006 | Bakx | |
| 7,104,435 | B2 | 9/2006 | Holley, Jr. | |
| 7,134,593 | B2 | 11/2006 | Harrelson | |
| 7,163,103 | B2 | 1/2007 | Bakx et al. | |
| 7,168,558 | B2 | 1/2007 | Harrelson | |
| 7,225,930 | B2 | 6/2007 | Ford et al. | |
| 7,240,789 | B2 | 7/2007 | Sutherland | |
| 7,264,114 | B2 | 9/2007 | Daniel | |
| 7,374,038 | B2 | 5/2008 | Smalley | |
| 7,690,507 | B2 | 4/2010 | Sutherland | |
| 7,721,878 | B2 | 5/2010 | Requena | |
| 7,789,231 | B2 | 9/2010 | Requena | |
| 7,823,721 | B2 | 11/2010 | Sutherland | |
| 8,056,709 | B2 | 11/2011 | Sutherland | |
| 8,096,413 | B2 | 1/2012 | DePaula | |
| 8,162,135 | B2 | 4/2012 | Oliveira | |
| 8,256,617 | B2 | 9/2012 | Gomes et al. | |
| 8,348,142 | B2 | 1/2013 | Smalley | |
| 8,469,184 | B2 * | 6/2013 | Spivey, Sr. | 206/162 |
| 2002/0029991 | A1 | 3/2002 | Lingamfelter | |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2002/0185499 | A1 | 12/2002 | Harrelson et al. | |
| 2002/0195371 | A1 | 12/2002 | Brown | |
| 2003/0080004 | A1 | 5/2003 | Olsen et al. | |
| 2003/0141313 | A1 | 7/2003 | Bates | |
| 2003/0150759 | A1 | 8/2003 | White, Jr. | |
| 2003/0192907 | A1 | 10/2003 | Bates | |
| 2003/0213705 | A1 | 11/2003 | Woog | |
| 2004/0011674 | A1 | 1/2004 | Theelen | |
| 2004/0060972 | A1 | 4/2004 | Harrelson | |
| 2004/0079666 | A1 | 4/2004 | Bakx | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0226833 | A1 | 11/2004 | Daniel | |
| 2005/0023170 | A1 | 2/2005 | Lingamfelter | |
| 2005/0092820 | A1 | 5/2005 | Chekroune | |
| 2005/0103650 | A1 | 5/2005 | Auclair et al. | |
| 2005/0126947 | A1 | 6/2005 | Holley, Jr. | |
| 2005/0127151 | A1 | 6/2005 | Johnson | |
| 2005/0178791 | A1 | 8/2005 | Miller | |
| 2005/0189405 | A1 | 9/2005 | Gomes et al. | |
| 2005/0224565 | A1 | 10/2005 | Holley | |
| 2006/0054522 | A1 | 3/2006 | Kline et al. | |
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2008/0121536 | A1 | 5/2008 | Miret | |
| 2008/0135423 | A1 | 6/2008 | Oliveira | |
| 2009/0101526 | A1 | 4/2009 | Sutherland et al. | |
| 2009/0127147 | A1 | 5/2009 | Sutherland | |
| 2009/0242445 | A1 | 10/2009 | Gomes et al. | |
| 2010/0264043 | A1 | 10/2010 | De Paula | |
| 2011/0000799 | A1 | 1/2011 | Gonzalez | |
| 2011/0284623 | A1 | 11/2011 | Jones et al. | |
| 2012/0080328 | A1 | 4/2012 | DePaula | |
| 2012/0138489 | A1 | 6/2012 | Holley, Jr. | |
| 2012/0285854 | A1 | 11/2012 | Spivey, Sr. | |

FOREIGN PATENT DOCUMENTS

| | | | |
|---|---|---|---|
| DE | 202 13 450 | U1 | 11/2002 |
| DE | 203 17 334 | U1 | 2/2004 |
| DE | 20 2004 004 248 | U1 | 8/2004 |
| DE | 20 2004 017 954 | U1 | 2/2005 |
| EP | 0 048 506 | | 3/1982 |
| EP | 0 285 043 | A1 | 10/1988 |
| EP | 0 398 835 | B1 | 11/1990 |
| EP | 0 495 197 | A1 | 7/1992 |
| EP | 0 066 029 | A1 | 12/1992 |
| EP | 0 541 334 | A1 | 5/1993 |
| EP | 0 636 554 | A2 | 2/1995 |
| EP | 0 780 320 | A1 | 6/1997 |
| EP | 0 806 372 | | 6/1997 |
| EP | 1 070 671 | A1 | 1/2001 |
| EP | 1 384 679 | | 1/2004 |
| FR | 1 582 235 | | 9/1969 |
| FR | 2 525 992 | | 11/1983 |
| FR | 2 549 010 | | 1/1985 |
| FR | 2 664 239 | | 1/1992 |
| FR | 2 731 413 | | 9/1996 |
| GB | 1 342 180 | | 12/1973 |
| GB | 2 085 391 | A | 4/1982 |
| GB | 2 158 037 | A | 11/1985 |
| GB | 2 264 101 | A | 8/1993 |
| JP | 2003-146359 | | 5/2003 |
| WO | WO 93/25439 | A1 | 12/1993 |
| WO | WO 96/29260 | | 9/1996 |

(56) References Cited

FOREIGN PATENT DOCUMENTS

| | | | |
|---|---|---|---|
| WO | WO 97/33807 | | 9/1997 |
| WO | WO 98/49071 | A1 | 11/1998 |
| WO | WO 99/01356 | | 1/1999 |
| WO | WO 99/64301 | | 12/1999 |
| WO | WO 00/03937 | | 1/2000 |
| WO | WO 02/47990 | A2 | 6/2002 |
| WO | WO 02/059011 | A2 | 8/2002 |
| WO | WO 02/062676 | A1 | 8/2002 |
| WO | WO 02/079048 | A1 | 10/2002 |
| WO | WO 03/016167 | A1 | 2/2003 |
| WO | WO 2004/043790 | A2 | 5/2004 |
| WO | WO 2005/051781 | A1 | 6/2005 |
| WO | WO 2005/095222 | A1 | 10/2005 |
| WO | WO 2006/044583 | A2 | 4/2006 |
| WO | WO 2006/050210 | A2 | 5/2006 |
| WO | WO 2006/050316 | A1 | 5/2006 |
| WO | WO 2006/108098 | A1 | 10/2006 |
| WO | WO 2007/044525 | A1 | 4/2007 |
| WO | WO 2007/089844 | A1 | 8/2007 |

* cited by examiner

CARRIER FOR BOTTLES

CROSS-REFERENCE TO RELATED APPLICATIONS

This application is a continuation application of PCT/US2011/045704, filed Jul. 28, 2011, which application claims the benefit of U.S. Provisional Patent Application No. 61/400,625, filed Jul. 30, 2010.

INCORPORATION BY REFERENCE

The disclosures of PCT/US2011/045704, which was filed on Jul. 28, 2011, and U.S. Provisional Patent Application No. 61/400,625, which was filed on Jul. 30, 2010, are hereby incorporated by reference for all purposes as if presented herein in its entirety.

BACKGROUND OF THE DISCLOSURE

The present disclosure generally relates to packages or carriers for holding, displaying, and/or carrying containers.

SUMMARY OF THE DISCLOSURE

In general, one aspect of the disclosure is directed to a carrier for holding a plurality of containers. The carrier can comprise a bottom panel, a top panel at least partially in face-to-face contact with the bottom panel, a handle comprising a bottom gripping portion in the bottom panel and a top gripping portion in the top panel, and at least one container receiver for at least partially receiving a respective container of the plurality of containers. The at least one container receiver is foldably connected to the handle.

In another aspect, the disclosure is generally directed to a blank for forming a carrier for holding a plurality of containers. The blank can comprise a bottom panel, a top panel foldably connected to the bottom panel along a longitudinal fold line, and a bottom gripping portion in the bottom panel and a top gripping portion in the top panel. The bottom gripping portion is for being positioned relative to the top gripping portion to form a handle when the carrier is formed from the blank. The blank can further comprise at least one bottom container-receiving portion foldably connected to the bottom gripping portion in the bottom panel and at least one top container-receiving portion foldably connected to the top gripping portion in the top panel. The at least one bottom container-receiving portion can be positionable relative to the at least one top container-receiving portion to form at least one container receiver for at least partially receiving a respective container of the plurality of containers when the carrier is formed from the blank, the at least one container receiver being foldably connected to the handle.

In another aspect, the disclosure is generally directed to a method of forming a package comprising a carrier and a plurality of containers. The method can comprise obtaining a carrier blank comprising a bottom panel, a top panel foldably connected to the bottom panel along a longitudinal fold line, a bottom gripping portion in the bottom panel, a top gripping portion in the top panel, at least one bottom container-receiving portion foldably connected to the bottom gripping portion in the bottom panel, and at least one top container-receiving portion foldably connected to the top gripping portion in the top panel. The method can further comprise forming a handle and at least one container receiver by folding the top panel along the longitudinal fold line into face-to-face contact with the bottom panel so that the top gripping portion is substantially in face-to-face contact with the bottom gripping portion to form the handle and the at least one bottom container-receiving portion is in face-to-face contact with the at least one top container-receiving portion to form the at least one container receiver. The method can further comprise inserting at least a portion of a container of the plurality of containers into the at least one container receiver.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Carriers according to the present disclosure can accommodate containers of numerous different shapes. For the purpose of illustration and not for the purpose of limiting the scope of the disclosure, the following detailed description describes beverage product containers (e.g., plastic containers) at least partially disposed within the carrier embodiments. In this specification, the terms "lower," "bottom," "upper," and "top" indicate orientations determined in relation to fully erected carriers or packages.

The present embodiments are addressed to carriers or packages for attachment to and accommodation of containers. A carrier or package 150 is illustrated in its erected state in FIGS. 2-4, in which it is attached to containers C. In the illustrated embodiments the containers C are illustrated as two beverage containers each having a top portion generally comprising an upper neck portion N (FIG. 2), a cap CP, and an annular shoulder S below the cap. Less than or more than two containers C can be held in the carrier 150, and the containers can be otherwise sized and shaped without departing from the disclosure. The carrier 150 includes a handle 7 (FIG. 2) for grasping and carrying a central portion of the carrier and two container receivers 200 foldably connected to the handle 7 at respective ends of the handle. The carrier could have more or less than two container receivers without departing from the disclosure. Further, the carrier 150 could have one or more container receivers that are not foldably connected to the handle 7 without departing from the disclosure.

Figure 1:
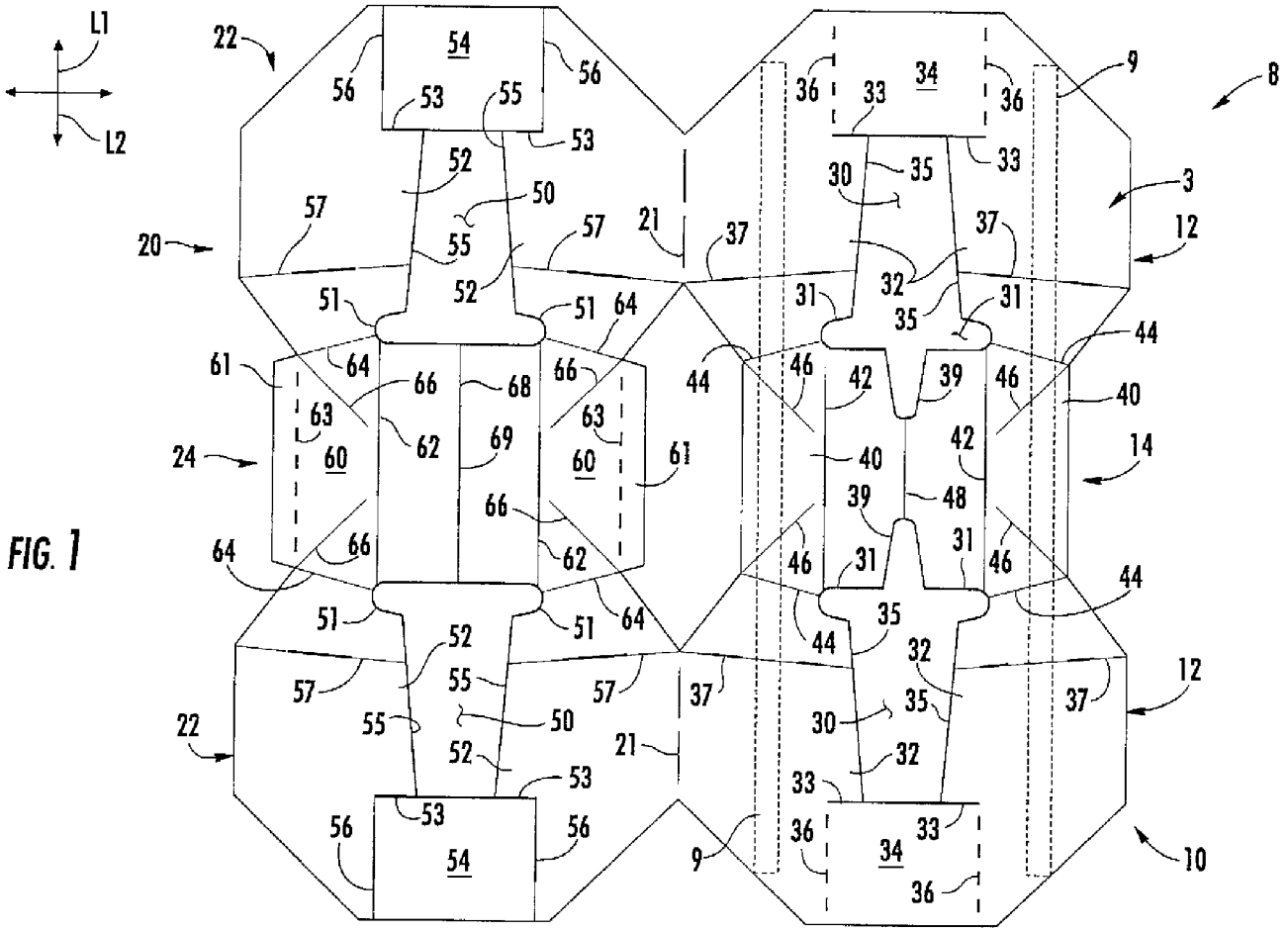
FIG. 1 is a plan view of the interior side of a blank according to one exemplary embodiment of the disclosure.

FIG. 1 is a plan view of an interior side 3 of a blank 8 used to form the carrier or package 150. The blank 8 has a longitudinal axis L1 and a lateral axis L2. The blank 8 comprises a bottom panel 10 foldably connected to a top panel 20 at a longitudinal fold line 21. One or more cuts can be included in the longitudinal fold line 21, or other fold lines, to facilitate folding along the fold lines. Any number of cuts may be formed in any of the fold lines, and the number and length of the cuts may be selected according to, for example, the gauge and/or the stiffness of the material used to form the blank 8. The fold lines alternatively may be formed by other methods (e.g., crease lines without cuts) without departing from the disclosure.

In FIG. 1, glue areas 9 for securing the bottom panel 10 to the top panel 20 are shown extending longitudinally on the interior surface of the bottom panel 10. Alternatively, the glue areas can have any shape or orientation and can be applied to the bottom panel 10, the top panel 20, or both.

According to the illustrated embodiment, the bottom panel 10 includes two bottom container-receiving portions 12 and a bottom gripping portion 14. A bottom opening 30 extends between two bottom retainer flaps 32 in each bottom container-receiving portion 12, and each bottom opening 30 is shaped and sized to receive the upper neck portion N of a container C (FIG. 2) that is to be at least partially accommodated within the carrier 150. The bottom openings 30 can extend generally in the respective bottom container-receiving portion 12 from the bottom gripping portion 14 to a respective bottom end portion 34. The blank 8 can comprise more or less than two bottom container-receiving portions 12 and bottom openings 30 without departing from the disclosure. The bottom retainer flaps 32 each can be defined by a widened, laterally-extending portion 31 of the bottom opening 30, a lateral cut line 33, and an oblique bottom edge 35. In the illustrated embodiment, the bottom edges 35 taper from the lateral portion 31 to the respective lateral cut line 33 for resisting translation of a container C received in the bottom opening 30 away from the bottom gripping portion 14.

According to the exemplary embodiment, each of the bottom end portions 34 can be defined by longitudinal fold lines 36 and the lateral cut lines 33. As shown in FIG. 1, the fold lines 36 can be lines of perforations; however, any line, such as a crease or a tear line, can be used without departing from the disclosure. Side fold lines 37 can extend from the bottom edges 35 of the bottom retainer flaps 32 to the edges of the bottom container-receiving portions 12 for allowing the bottom container-receiving portions to conform at least partially around the curved shape of the containers C. In the illustrated embodiment, the bottom container-receiving portions 12 include oblique edges extending from a longitudinal edge or the longitudinal fold line 21 to a lateral edge or bottom gripping portion 14. Alternatively, the bottom container-receiving portions 12 can have any shape without departing from the disclosure.

As shown in FIG. 1, the bottom gripping portion 14 can be narrower than the bottom container-receiving portions 12 and includes bottom side panels 40, each defined by a longitudinal fold line 42 and connected to the bottom container-receiving portions 12 by oblique fold lines 44. An oblique score or crease 46 extends from each of the outer corners of the bottom side panels 40 for allowing deformation of the side panels around a user's fingers when gripping the handle 7. The bottom gripping portion 14 further includes a longitudinal fold line 48 extending generally along the longitudinal axis of the bottom panel 10 between longitudinal extensions 39 of the openings 30.

Figure 2:
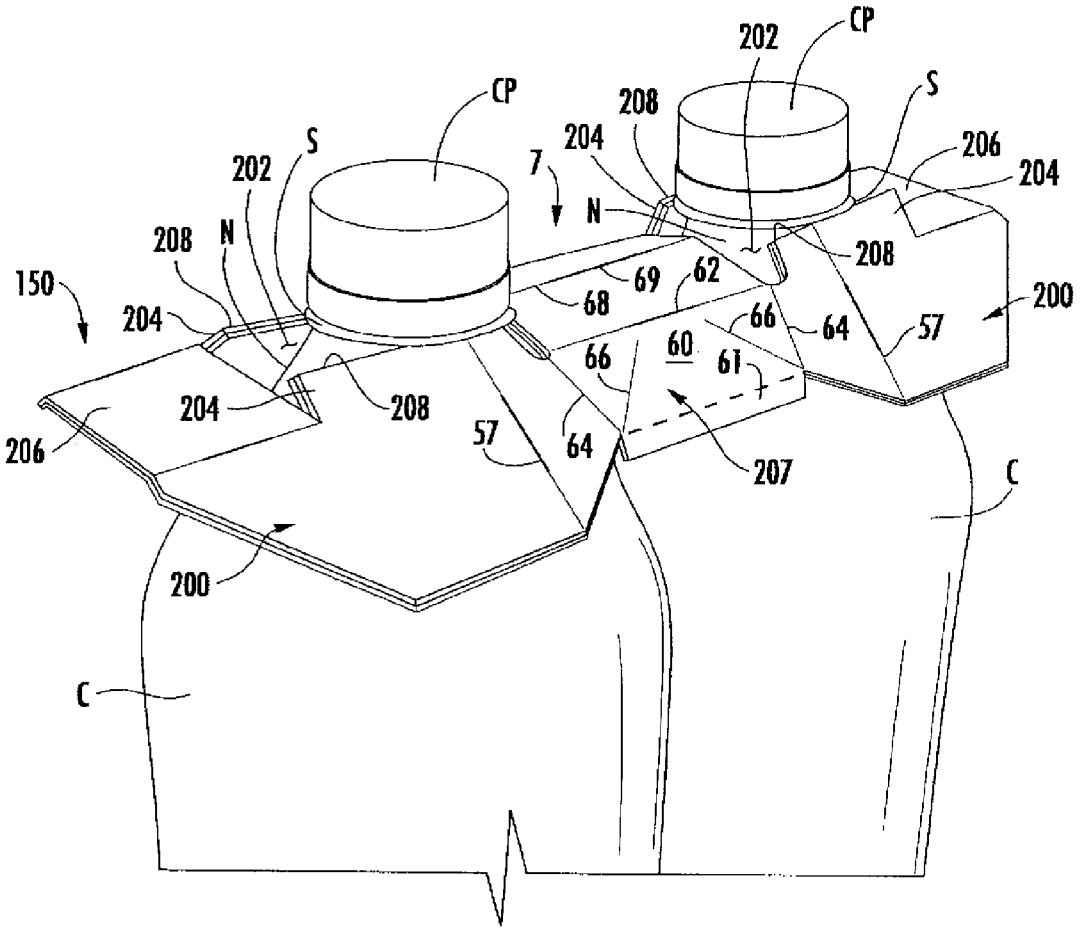
FIG. 2 is a side perspective view of the erected carrier with containers according to the exemplary embodiment of the disclosure.

In the illustrated embodiment, the top panel 20 is similar in shape and functionality as the bottom panel 10. As shown in FIG. 1, the top panel 20 includes two top container-receiving portions 22 and a top gripping portion 24. A top opening 50 extends between two top retainer flaps 52 in each top container-receiving portion 22, and each top opening 50 is shaped and sized to be generally aligned with a respective bottom opening 30 in the bottom panel 10 for receiving the upper neck portion N of a container C (FIG. 2). The top openings 50 can extend generally in the respective top container-receiving portion 22 from the top gripping portion 24 to a respective top end portion 54. The blank 8 can comprise more or less than two top container-receiving portions 22 and top openings 50 without departing from the disclosure. The top retainer flaps 52 each can be defined by a widened, laterally-extending portion 51 of the top opening 50, a lateral cut line 53, and an oblique top edge 55. In the illustrated embodiment, the top edges 55 taper from the lateral portion 51 to the lateral cut line 53 for resisting translation of a container C received in the top opening 50 away from the top gripping portion 24.

According to the exemplary embodiment, each of the top end portions 54 can be defined by longitudinal fold lines 56 and the lateral cut lines 53. As shown in FIG. 1, the fold lines 56 can be crease lines with centrally-disposed cut lines; however, any line, such as a crease or a tear line, can be used without departing from the disclosure. Side fold lines 57 can extend from the top edges 55 of the top retainer flaps 52 to the edges of the top container-receiving portions 22 for allowing the top container-receiving portions to conform at least partially around the curved shape of the containers C. In the illustrated embodiment, the top container-receiving portions 22 each have a generally similar or identical shape as the bottom container-receiving portions 12 so that the edges of the top container-receiving portions 22 generally align with the edges of the bottom container-receiving portions 12 when the carrier 150 is formed. Alternatively, the container-receiving portions 12, 22 can be shaped differently or can have any shape without departing from the disclosure.

As shown in FIG. 1, the top gripping portion 24 of the top panel 20 is narrower than the top container-receiving portions 22 and includes top side panels 60, each defined by a longitudinal fold line 62 and connected to the top container-receiving portions 22 by oblique fold lines 64. An oblique score or crease 66 extends from each of the outer corners of the top side panels 60 for allowing deformation of the side panels around a user's fingers when gripping the handle 7. The top gripping portion 24 optionally includes a comfort flap 61 connected to each of the top side panels 60 by a longitudinal fold line 63. The top gripping portion 24 can further include a longitudinal fold line 68 extending generally along the longitudinal axis of the top panel 20 between the top openings 50. A cut line 69 can extend along a central portion of the longitudinal fold line 68 and is for being generally aligned with the fold line 48 of the gripping portion 14 when the carrier 150 is formed.

Handle features of the blank 8 for forming the handle 7 include the bottom gripping portion 14 of the bottom panel 10 and the top gripping portion 24 of the top panel 20. The blank 8 could have other handle features without departing from the disclosure. Additionally, the blank 8 could have more than one bottom gripping portion in the bottom panel 10 and more than one top gripping portion in the top panel 20 for forming more than one handle in the carrier 150.

An exemplary method of erecting the carrier 150 is discussed in detail below. At various stages in the erecting, respective portions of the blank 8 are mounted to one another in any suitable manner. For example, at various stages of the erecting process, glue or other adhesive material can be applied at various portions of the blank 8. For example, the adhesive material may be present where appropriate surfaces of the blank are in face-to-face contact. Depending upon the amount and/or type of adhesive material or other fastening mechanisms used, each of the face-to-face contacts described in this disclosure may be more generally referred to as the respective features being in substantially face-to-face contact or at least partially in face-to-face contact.

Figure 3:
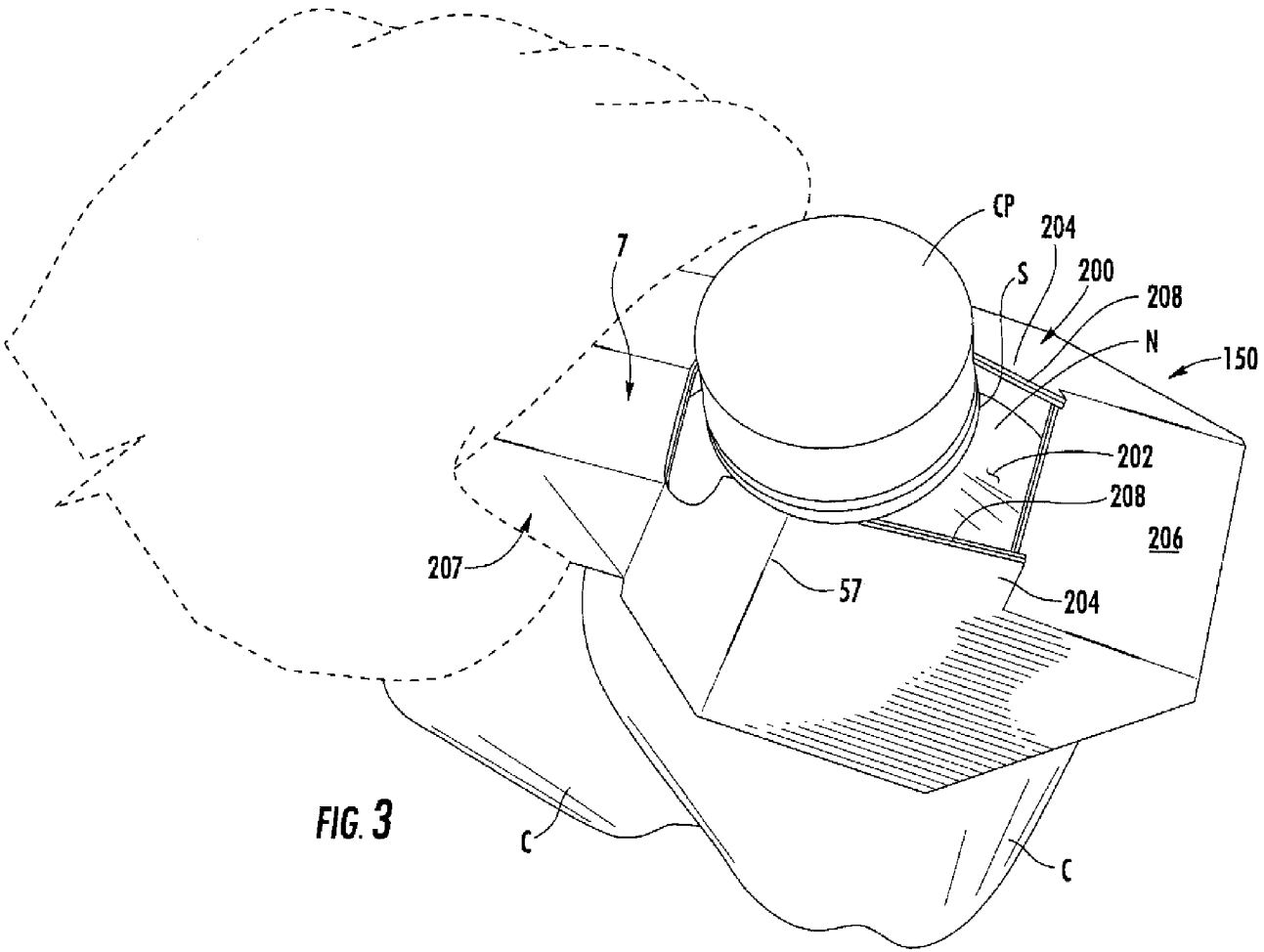
FIG. 3 is a top perspective view showing one end of the carrier.
Figure 4:
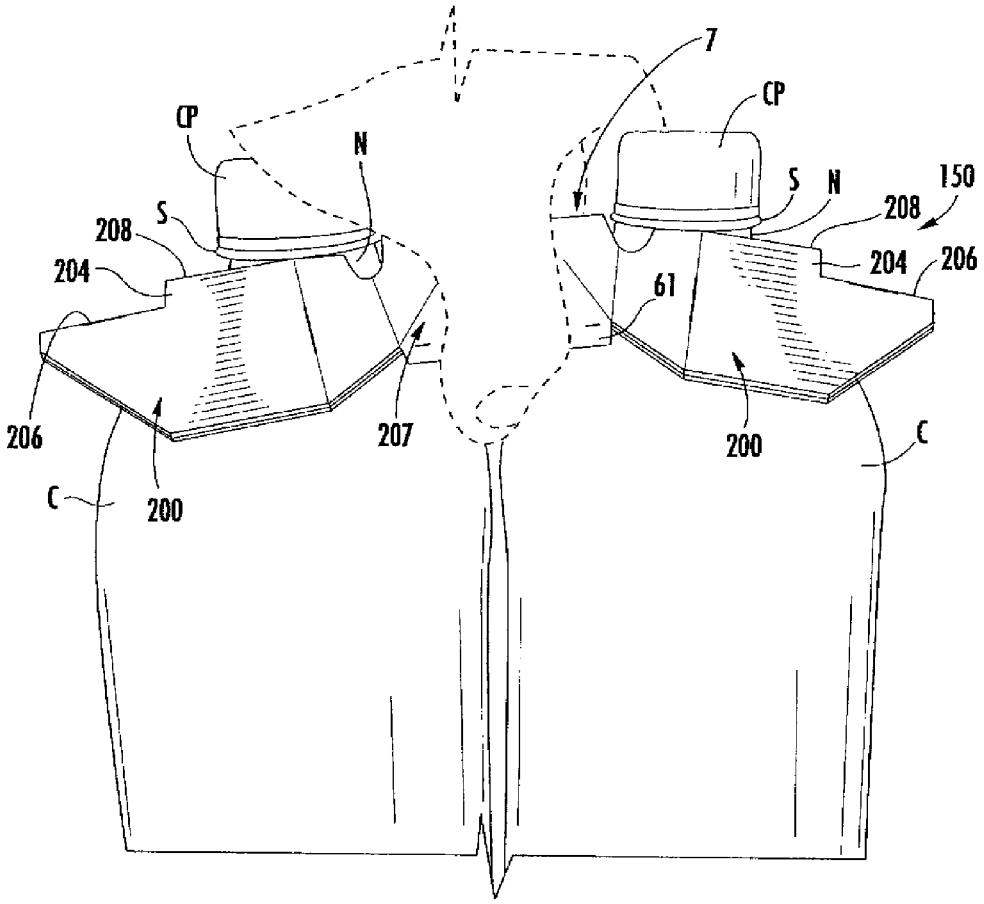
FIG. 4 is a side view of the carrier being carried.

The erected carrier 150 illustrated in FIGS. 2-4 is formed by applying glue or any suitable adhesive to the glue areas 9 and/or other areas and folding the top panel 20 and/or the bottom panel 10 about the longitudinal fold line 21 so that the interior surface of the top panel is in face-to-face contact with the interior surface of the bottom panel 10 to secure or mount the top panel to the bottom panel. In the illustrated embodiment, each of the bottom container-receiving portions 12 of the bottom panel 10 is secured to a respective top container-receiving portion 22 of the top panel 20 to form respective container receivers 200. The bottom openings 30 and bottom retainer flaps 32 of the bottom panel are generally aligned with corresponding top openings 50 and top retainer flaps 52 of the top panel to form respective openings 202 and retainer flaps 204 in the carrier 150. Each of the bottom end portions 34 of the bottom panel 10 is in face-to-face contact with a corresponding top end portion 54 of the top panel 20, forming an end panel 206 of the carrier 150. Further, the top gripping portion 24 of the top panel 20 is in face-to-face contact with and secured to the bottom gripping portion 14 of the bottom panel 10 to form the handle 7, and the top side panels 60 are overlapped with the corresponding bottom side panels 40 to form respective side panels 207. The two-ply carrier 150, including overlapped and adhered container-receiving portions 12, 22 and gripping portions 14, 24, provides a reinforced carrier for helping to withstand substantial loading without tearing, bending, or otherwise weakening of the carrier when the handle 7 is grasped to carry the containers C.

The carrier 150 can then be placed onto the containers C such that the neck portion N of each of the containers is respectively received in the openings 202 and the retainer flaps 204 are respectively upwardly folded. Particularly, the retainer flaps 204 pivot outwardly as the cap CP passes through the opening 202 until the shoulder S passes through. The retainer flaps 204 then can pivot inwardly so the edges 208 of the retainer flaps 204 engage the shoulder S or other suitable feature at opposite sides of the containers C to at least partially provide a retaining force for holding the containers in the carrier (FIG. 3). The bottom panel 10 and the top panel 20 can fold along the generally aligned fold lines 48, 68; 42, 62; 44, 64; 46, 66; 37, 57 to at least partially conform to the shape of containers C when retainer flaps 204 pivot upwardly. Each of the container receivers 200 can be sloped on either side of the respective opening 202 and end panel 206 so that the retainer flaps 204 are directed generally inwardly and upwardly under the shoulder S of the container C received in the container receiver 200. Also, the cut 69 in the top panel 20 can partially split to generally accommodate folding and/or deformation of the fold line 48 in the bottom panel 10, and the longitudinal extensions 39 of the openings 30 in the bottom panel 10 can generally accommodate folding and/or deformation of the fold line 68 in the top panel 20.

A user can carry the assembled package and containers by gripping the handle 7 with a thumb on one side of the handle and a finger on the other side of the handle as shown in FIG. 4. Lifting the carrier by the handle 7 deforms the gripping portions 14, 24 at least at fold lines 42/62, 44/64, 46/66, and 48/68 to conform at least partially to the user's fingers. The retainer flaps 204 are pivoted upwardly so the edges 208 engage an underside of the respective shoulders S of the containers C, lifting the containers with the carrier. As the carrier 150 is lifted, the carrier can bend in the handle 7 so that the container receivers 200 pivot downwardly and the bottoms of the containers C pivot toward one another (FIG. 4). The comfort flaps 61 can be folded downwardly about the respective fold lines 63 to protect the user from the outer edges of the corresponding side panels 40. Alternatively, the handle 7 can be gripped differently, or a different handle configuration can be used without departing from the disclosure.

In the illustrated embodiment, the carrier 150 is retained on the containers C by the engagement of the retainer flaps 204 with portions of the shoulders S of the containers. The edges 208 of the flaps 204 engage an underside of a respective shoulder S at opposite sides of each container to apply a retention force that tends to prevent withdrawal of each container from the carrier. The retention force from the engagement of the retaining edges 204 with the shoulder S creates an upward bias force that retains the container C and resists removal of the containers. In addition, the narrowing of openings 202 toward the end panels 206 can bias the containers toward the handle 7. In one embodiment, the upward bias force may be overcome or eliminated such as by tearing or manipulation of the carrier 150, in order to withdraw the container C from the carrier. The containers C can be otherwise retained in the carrier without departing from the disclosure.

According to the exemplary embodiment, a container C can be removed from the carrier 150 by squeezing the container receivers 200 at one end of the carrier inwardly and downwardly to pivot the retainer flaps 204 away from the shoulder S. The container C can then be pulled downwardly so that the shoulder S and cap CP pass through the opening 202.

Alternatively, a container C can be removed from the carrier 150 by tearing away the adjacent end panel 206 from the carrier 150. Particularly, the end portions 34, 54 of the container-receiving portions 12, 22 forming the end panel 206 can be torn along the respective lines 36, 56. The user can reach into the opening 202 with a finger and pull upwardly and outwardly on the end panel 206 to tear it along lines 36, 56. The remaining portions of the container-receiving portions 12, 22 can then pivot about respective fold lines 44, 64 to allow the retainer flaps 204 to move apart. The container C can then easily slide out of the opening 202. The carrier 150 can have other dispensing features to remove the containers C from the carrier 150 without departing from the disclosure.

In the illustrated embodiment, the container receivers 200 are foldably connected to the handle 7 at fold lines 44, 64. The foldable connection between the container receivers 200 and the handle 7 allows the container receivers to flex when the carrier is lifted by grasping the handle. The container receivers 200 could be otherwise shaped, arranged, and/or configured without departing from the disclosure. Further, the carrier 150 could have additional container receivers that are foldably connected to a respective one of the container receivers 200 shown to accommodate additional containers C without departing from the disclosure. Also, the carrier 150 could have a line of weakness for separating a respective container receiver 200 from the carrier to facilitate dispensing of the containers C from the carrier.

In general, the blank may be constructed from paperboard having a caliper so that it is heavier and more rigid than ordinary paper. The blank can also be constructed of other materials, such as cardboard, or any other material having properties suitable for enabling the carton to function at least generally as described above.

The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

The above embodiments may be described as having one or panels adhered together by glue. The term "glue" is intended to encompass all manner of adhesives commonly used to secure paperboard carton panels in place, and the adhesive material can be replaced by, or supplemented with any suitable fastening devices.

The term "line" as used herein includes not only straight lines, but also other types of lines such as curved, curvilinear or angularly displaced lines.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, cut line, or the like. For example, a cut line can be a continuous slit or could be wider than a slit without departing from the present disclosure.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a bottom panel;

a top panel at least partially in face-to-face contact with the bottom panel, wherein the top panel is foldably connected to the bottom panel along a longitudinal fold line;

a handle comprising a bottom gripping portion in the bottom panel and a top gripping portion in the top panel, the bottom gripping portion comprising a first edge and an opposing second edge, and the top gripping portion comprising a third edge and an opposing fourth edge;

at least a first container receiver and a second container receiver for at least partially receiving a respective container of the plurality of containers, wherein the first container receiver is foldably connected to the handle along at least a first fold line and a second fold line, and the second container receiver is foldably connected to the handle along at least a third fold line and a fourth fold line; and a first opening at least partially defined by the first container receiver and the handle and a second opening at least partially defined by the second container receiver and the handle, the first edge of the bottom gripping portion and the third edge of the top gripping portion at least partially defining the first opening, and the second edge of the bottom gripping portion and the fourth edge of the top gripping portion at least partially defining the second opening.

2. The carrier of claim 1, wherein each of the first container receiver and the second container receiver comprises a bottom container-receiving portion in the bottom panel and a top container-receiving portion in the top panel, each of the bottom container-receiving portions being in face-to-face contact with the respective top container-receiving portions.

3. The carrier of claim 2, wherein the first container receiver comprises a first retainer flap and an opposing second retainer flap disposed adjacent the first opening, each of the first retainer flap and the second retainer flap comprising an edge for engaging a shoulder of the respective container received in the first container receiver, and the second container receiver comprises a third retainer flap and an opposing fourth retainer flap disposed adjacent the second opening, each of the third retainer flap and the fourth retainer flap comprising an edge for engaging a shoulder of the respective container received in the second container receiver.

4. The carrier of claim 3, further comprising at least one end panel, wherein the at least one end panel is foldably connected to at least one of the first container receiver and the second container receiver, and the at least one end panel is disposed generally opposite to the handle.

5. The carrier of claim 4, wherein the at least one end panel comprises a bottom end portion in the bottom panel and a top end portion in the top panel.

6. The carrier of claim 5, wherein the top end portion is connected to the top container-receiving portion of the first container receiver or the second container receiver along two top longitudinal fold lines, and the bottom end portion is connected to the bottom container-receiving portion of the first container receiver or the second container receiver along two bottom longitudinal fold lines.

7. The carrier of claim 5, wherein the top end portion is connected to the top container-receiving portion of the first container receiver or the second container receiver along two top longitudinal tear lines, the bottom end portion is connected to the bottom container-receiving portion of the first container receiver or the second container receiver along two bottom longitudinal tear lines, and the bottom longitudinal tear lines are generally aligned with the respective top longitudinal tear lines.

8. The carrier of claim 4, wherein each of first opening and the second opening comprises a widened lateral portion at least partially defined by the handle, and at least one of the first opening and the second opening is further defined by an edge of the at least one end panel.

9. The carrier of claim 8, wherein each of the first retainer flap and the second retainer flap is at least partially defined by the lateral portion of the opening and a cut line separating the respective first or second retainer flap from the at least one end panel.

10. The carrier of claim 4, wherein:

the handle comprises a first bottom side panel and an opposing second bottom side panel foldably connected to the bottom gripping portion of the handle;

the handle comprises a first top side panel and an opposing second top side panel foldably connected to the top gripping portion of the handle;

the first top side panel and the second top side panel are in substantially face-to-face contact with the respective first bottom side panel and second bottom side panel;

each of the bottom container-receiving portions of the first container receiver and the second container receiver is foldably connected to the first bottom side panel and the second bottom side panel; and each of the top container-receiving portions of the first container receiver and the second container receiver is foldably connected to the first top side panel and the second top side panel.

11. The carrier of claim 3, wherein the handle comprises a first bottom side panel and an opposing second bottom side panel foldably connected to the bottom gripping portion of the handle;

the handle comprises a first top side panel and an opposing second top side panel foldably connected to the top gripping portion of the handle; and the first top side panel and the second top side panel are in substantially face-to-face contact with the respective first bottom side panel and second bottom side panel.

12. The carrier of claim 11, wherein each of the bottom container-receiving portions of the first container receiver and the second container receiver is foldably connected to the first bottom side panel and the second bottom side panel, and each of the top container-receiving portions of the first container receiver and the second container receiver is foldably connected to the first top side panel and the second top side panel.

13. The carrier of claim 12, wherein each of the bottom container-receiving portion and the top container receiving portion of the first container receiver comprises a first side fold line and a second side fold line, the first side fold line extending from the edge of the first retainer flap to an edge of the respective bottom and top panels, and the second side fold line extending from the edge of the second retainer flap to an edge of the respective bottom and top panels, the first side fold line of the bottom panel is generally aligned with the first side fold line of the top panel, and the second side fold line of the bottom panel is generally aligned with the second side fold line of the top panel, and each of the first bottom side panel, the second bottom side panel, the first top side panel, and the second top side panel comprises an oblique score.

14. The carrier of claim 1, wherein the first fold line is spaced apart from the second fold line by the first opening, and the third fold line is spaced apart from the fourth fold line by the second opening.

15. The carrier of claim 2, wherein each of the bottom container-receiving portions of the first container receiver and the second container receiver is foldably connected to the respective top container-receiving portion of the first container receiver and the second container receiver along the longitudinal fold line.

16. The carrier of claim 1, wherein each of the first fold line, the second fold line, the third fold line, and the fourth fold line is nonparallel with the longitudinal fold line.

17. A blank for forming a carrier for holding a plurality of containers, the blank comprising:

a bottom panel;

a top panel foldably connected to the bottom panel along a longitudinal fold line, wherein the top panel is for being positioned at least partially in face-to-face contact with the bottom panel when the carrier is formed from the blank;

a bottom gripping portion in the bottom panel and a top gripping portion in the top panel, the bottom gripping portion comprising a first edge and an opposing second edge, and the top gripping portion comprising a third edge and an opposing fourth edge, the bottom gripping portion for being positioned relative to the top gripping portion to form a handle when the carrier is formed from the blank;

features for forming at least a first container receiver and a second container receiver when the carrier is formed from the blank, the features comprising a bottom container-receiving portion foldably connected to the bottom gripping portion in the bottom panel and a top container-receiving portion foldably connected to the top gripping portion in the top panel for each of the first container receiver and the second container receiver, the bottom container-receiving portions being positionable relative to the respective top container-receiving portions to form the respective first container receiver and second container receiver for at least partially receiving a respective container of the plurality of containers when the carrier is formed from the blank, the first container receiver being foldably connected to the handle along at least a first fold line and a second fold line when the carrier is formed from the blank, and the second container receiver being foldably connected to the handle along at least a third fold line and a fourth fold line when the carrier is formed from the blank; and wherein each of the bottom container-receiving portions of the respective first container receiver and second container receiver at least partially defines a respective bottom opening, and each of the top container-receiving portions of the respective first container receiver and the second container receiver at least partially defines a respective top opening, each bottom opening for being aligned with the respective top opening in the carrier formed from the blank;

wherein the first edge and the second edge of the bottom gripping portion at least partially define the respective bottom openings, and the third edge and the fourth edge of the top gripping portion at least partially define the respective top openings.

18. The blank of claim 17, wherein:

each of the bottom container-receiving portions comprises a first bottom retainer flap and an opposing second bottom retainer flap disposed adjacent the respective bottom opening, each of the first bottom retainer flaps and the second bottom retainer flaps comprising a bottom edge for engaging a shoulder of the respective container of the plurality of containers; and each of the top container-receiving portions comprises a first top retainer flap and an opposing second top retainer flap disposed adjacent the respective top opening, each of the first top retainer flaps and the second top retainer flaps comprising a top edge for engaging the shoulder of the respective container of the plurality of containers.

19. The blank of claim 18, wherein:

the bottom panel comprises a respective bottom end portion foldably connected to each of the bottom container-receiving portions generally opposite to the handle; and the top panel comprises a respective top end portion foldably connected to each of the top container-receiving portions generally opposite to the handle.

20. The blank of claim 19, wherein:

each of the bottom container-receiving portions is connected to the respective bottom end portion along two bottom longitudinal fold lines; and each of the top container-receiving portions is connected to the respective top end portion along two top longitudinal fold lines.

21. The blank of claim 19, wherein:

each of the bottom container-receiving portions is connected to the respective bottom end portion along two bottom longitudinal tear lines;

each of the top container-receiving portions is connected to the respective top end portion along two top longitudinal tear lines; and the bottom longitudinal tear lines are for being generally aligned with the respective top longitudinal tear lines when the carrier is formed from the blank.

22. The blank of claim 19, wherein:

each of the bottom openings comprises a widened lateral portion at least partially defined by the bottom gripping portion and an edge of the respective bottom end portion; and each of the top openings comprises a widened lateral portion at least partially defined by the top gripping portion and an edge of the respective top end portion.

23. The blank of claim 22, wherein:

each of the first bottom retainer flaps and the second bottom retainer flaps is at least partially defined by the lateral portion of the respective bottom opening and a cut line separating the respective first or second bottom retainer flap from the respective bottom end portion; and each of the first top retainer flaps and the second top retainer flaps is at least partially defined by the lateral portion of the respective top opening and a cut line separating the respective first or second top retainer flap from the respective top end portion.

24. The blank of claim 18, wherein:

the bottom panel comprises a first bottom side panel and an opposing second bottom side panel foldably connected to the bottom gripping portion;

the top panel comprises a first top side panel and an opposing second top side panel foldably connected to the top gripping portion; and the first top side panel and the second top side panel are for being positioned in substantially face-to-face contact with the respective first bottom side panel and second bottom side panel when the carrier is formed from the blank.

25. The blank of claim 24, wherein:

each of the bottom container-receiving portions is foldably connected to the first bottom side panel and the second bottom side panel; and each of the top container-receiving portions is foldably connected to the first top side panel and the second top side panel.

26. The blank of claim 25, wherein:

each of the bottom container-receiving portions comprises a first bottom side fold line and a second bottom side fold line, the first bottom side fold line extending from the bottom edge of the respective first bottom retainer flap to an edge of the bottom panel, and the second bottom side fold line extending from the bottom edge of the respective second bottom retainer flap to an edge of the bottom panel;

each of the top container-receiving portions comprises a first top side fold line and a second top side fold line, the first top side fold line extending from the top edge of the respective first top retainer flap to an edge of the top panel, and the second top side fold line extending from the top edge of the respective second top retainer flap to an edge of the top panel; and each of the first bottom side panel, the second bottom side panel, the first top side panel, and the second top side panel comprises an oblique score.

27. The blank of claim 17, wherein the first fold line is spaced apart from the second fold line by at least one of the bottom opening and the top opening of the first container receiver, and the third fold line is spaced apart from the fourth fold line by the second opening by at least one of the bottom opening and the top opening of the second container receiver.

28. The blank of claim 17, wherein each of the bottom container-receiving portions of the first container receiver and the second container receiver is foldably connected to the respective top container-receiving portion of the first container receiver and the second container receiver along the longitudinal fold line.

29. The carrier of claim 17, wherein each of the first fold line, the second fold line, the third fold line, and the fourth fold line is nonparallel with the longitudinal fold line.

30. A method of forming a package comprising a carrier and a plurality of containers, the method comprising:

obtaining a carrier blank comprising a bottom panel, a top panel foldably connected to the bottom panel along a longitudinal fold line, a bottom gripping portion in the bottom panel, a top gripping portion in the top panel, and features for forming at least a first container receiver and a second container receiver, the features comprising a bottom container-receiving portion foldably connected to the bottom gripping portion in the bottom panel and a top container-receiving portion foldably connected to the top gripping portion in the top panel for each of the first container receiver and the second container receiver, the bottom gripping portion comprising a first edge and an opposing second edge, and the top gripping portion comprising a third edge and an opposing fourth edge;

forming the carrier comprising a handle, the first container receiver, and the second container receiver, the first container receiver being foldably connected to the handle along a first fold line and a second fold line and the second container receiver being foldably connected to the handle along a third fold line and a fourth fold line, the forming the carrier comprising folding the top panel along the longitudinal fold line into face-to-face contact with the bottom panel so that the top gripping portion is substantially in face-to-face contact with the bottom gripping portion to form the handle and the bottom container-receiving portions are in face-to-face contact with the respective top container-receiving portions to form the respective first container receiver and second container receiver;

wherein the forming the carrier comprises forming a first opening at least partially defined by the first container receiver and the handle and a second opening at least partially defined by the second container receiver and the handle, the first edge of the bottom gripping portion and the third edge of the top gripping portion at least partially defining the first opening, and the second edge of the bottom gripping portion and the fourth edge of the top gripping portion at least partially defining the second opening; and inserting at least a portion of a container of the plurality of containers into each of the first container receiver and the second container receiver.

31. The method of claim 30, wherein:

the first container receiver comprises a first retainer flap and an opposing second retainer flap disposed adjacent the first opening, each of the first retainer flap and the second retainer flap comprising an edge;

the second container receiver comprises a third retainer flap and an opposing fourth retainer flap disposed adjacent the second opening, each of the third retainer flap and the fourth retainer flap comprising an edge; and the inserting at least a portion of the container of the plurality of containers comprises positioning a shoulder of the respective container so that at least a portion of at least one of the first retainer flap and the second retainer flap and at least a portion of at least one of the third retainer flap and the fourth retainer flap engages an underside of the respective shoulder.

32. The method of claim 31, wherein:

the bottom panel comprises a bottom end portion foldably connected to the bottom container-receiving portion of the respective first container receiver and second container receiver;

the top panel comprises a top end portion foldably connected to the top container-receiving portion of the respective first container receiver and second container receiver; and the method further comprises forming an end panel by positioning the bottom end portions in face-to-face contact with the respective top end portions when folding the top panel along the longitudinal fold line into face-to-face contact with the bottom panel.

33. The method of claim 32, wherein:

the handle comprises a first bottom side panel and an opposing second bottom side panel foldably connected to the bottom gripping portion of the handle;

the handle comprises a first top side panel and an opposing second top side panel foldably connected to the top gripping portion of the handle;

each of the bottom container-receiving portions of the first container receiver and the second container receiver is foldably connected to the first bottom side panel and the second bottom side panel;

each of the top container-receiving portions of the first container receiver and the second container receiver is foldably connected to the first top side panel and the second top side panel; and the forming the handle further comprises positioning the first top side panel and the second top side panel in substantially face-to-face contact with the respective first bottom side panel and second bottom side panel to respectively form a first side panel and a second side panel.

34. The method of claim 33, wherein the inserting the container of the plurality of containers further comprises folding the first side panel and the second side panel downwardly along at least one longitudinal fold line and positioning the first retainer flap and the second retainer flap of the first container receiver to extend at least partially upwardly from the first container receiver.

* * * * *